US009657632B2

(12) United States Patent
Abeska et al.

(10) Patent No.: US 9,657,632 B2
(45) Date of Patent: May 23, 2017

(54) METHOD AND APPARATUS FOR REMOTE TORQUE CONTROL OF AN AERODYNAMIC AIR SHUTTER MECHANISM

(75) Inventors: Edward J. Abeska, Ferndale, MI (US); David J. Verbrugge, Milford, MI (US); Scott P. Charnesky, Birmingham, MI (US); John C. Remy, Shelby Township, MI (US); Brian A. Macfarlane, Rochester Hills, MI (US); John F. Larsen, Campbellcroft (CA); David W. Turner, Algonac, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1012 days.

(21) Appl. No.: 13/564,184

(22) Filed: Aug. 1, 2012

(65) Prior Publication Data

US 2014/0038507 A1 Feb. 6, 2014

(51) Int. Cl.
*B60H 1/26* (2006.01)
*F01P 7/12* (2006.01)

(52) U.S. Cl.
CPC ..... *F01P 7/12* (2013.01); *F01P 2025/13* (2013.01)

(58) Field of Classification Search
CPC ..... F01P 7/12; F01P 2025/13
See application file for complete search history.

(56) References Cited

U.S. PATENT DOCUMENTS 2,261,584 A 11/1941 Knowlton et al.
4,476,820 A 10/1984 Nixon
4,756,279 A 7/1988 Temmesfeld
4,779,577 A 10/1988 Ritter et al.
4,924,826 A 5/1990 Vinson
5,269,264 A 12/1993 Weinhold
5,566,745 A 10/1996 Hill et al.
5,669,311 A 9/1997 Hill et al.
5,899,196 A 5/1999 Chite
5,912,538 A * 6/1999 Turner ..... F02D 11/107 318/280
6,029,625 A 2/2000 Bischof et al.
6,142,108 A 11/2000 Blichmann
6,145,251 A 11/2000 Ricci
(Continued)

FOREIGN PATENT DOCUMENTS

CN 1959052 A 5/2007
CN 101947908 A 1/2011
(Continued)

OTHER PUBLICATIONS

"2013 Chevrolet Malibu is No Drag in Aerodynamics," Dec. 12, 2011, http://media.gm.com/media/us/en/chevrolet/vehicles/malibu/2013.detail.html/content/Pages/news/us/en/2011/Dec/1212_malibu/1212_aerodynamics.html.*

*Primary Examiner* — Alissa Tompkins
*Assistant Examiner* — Phillip E Decker

(57) ABSTRACT

A system for controlling an aerodynamic shutter of a vehicle includes an ambient temperature estimation module that determines an ambient temperature. A shutter control module that determines whether to actuate the shutter based on the ambient temperature. The shutter control module also determines a predetermined period before selectively applying a predetermined torque value to the shutter. The predetermined period is selected based on the ambient temperature.

14 Claims, 5 Drawing Sheets

(56) References Cited

U.S. PATENT DOCUMENTS

| | | | | |
|---|---|---|---|---|
| 6,227,153 | B1 | 5/2001 | Till | |
| 6,230,832 | B1 | 5/2001 | von Mayenburg et al. | |
| 6,588,380 | B2 | 7/2003 | Ries-Mueller | |
| 6,759,643 | B2 | 7/2004 | Su et al. | |
| 6,854,544 | B2 | 2/2005 | Vide | |
| 6,918,456 | B2 | 7/2005 | Dennison et al. | |
| 7,128,026 | B2 | 10/2006 | Braun et al. | |
| 7,498,926 | B2 | 3/2009 | Browne et al. | |
| 7,644,793 | B2 | 1/2010 | Iwasaki et al. | |
| 7,766,111 | B2 | 8/2010 | Guilfoyle et al. | |
| 7,784,576 | B2 | 8/2010 | Guilfoyle et al. | |
| 8,020,536 | B2 | 9/2011 | Kardos | |
| 8,025,045 | B2 | 9/2011 | Pettersson et al. | |
| 8,161,919 | B2 | 4/2012 | Klotz et al. | |
| 8,281,754 | B2 | 10/2012 | Saida et al. | |
| 8,311,708 | B2 | 11/2012 | Kerns | |
| 8,517,130 | B2 | 8/2013 | Sakai | |
| 8,662,569 | B2 * | 3/2014 | Klop | 180/68.1 |
| 8,667,931 | B2 * | 3/2014 | Kerns | 180/68.1 |
| 8,689,917 | B2 | 4/2014 | Miesterfeld et al. | |
| 8,708,078 | B2 | 4/2014 | Charnesky et al. | |
| 8,731,782 | B2 * | 5/2014 | Kerns | F01P 7/10 701/101 |
| 8,833,498 | B2 | 9/2014 | Charnesky et al. | |
| 2004/0226764 | A1 | 11/2004 | Iwasaki et al. | |
| 2006/0005790 | A1 | 1/2006 | Braun et al. | |
| 2010/0243352 | A1 | 9/2010 | Watanabe et al. | |
| 2011/0010015 | A1 | 1/2011 | Jordan et al. | |
| 2011/0120395 | A1 * | 5/2011 | Kim | 123/41.05 |
| 2011/0281515 | A1 * | 11/2011 | Lockwood et al. | 454/75 |
| 2011/0288717 | A1 * | 11/2011 | Yu et al. | 454/75 |
| 2012/0100790 | A1 * | 4/2012 | Miesterfeld et al. | 454/75 |
| 2012/0100791 | A1 | 4/2012 | Charnesky et al. | |
| 2012/0111652 | A1 | 5/2012 | Charnesky et al. | |
| 2012/0132474 | A1 * | 5/2012 | Charnesky et al. | 180/68.1 |
| 2013/0264133 | A1 * | 10/2013 | Remy et al. | 180/68.1 |
| 2014/0039765 | A1 * | 2/2014 | Charnesky et al. | 701/49 |
| 2016/0368366 | A1 * | 12/2016 | Miller | F01P 7/12 |

FOREIGN PATENT DOCUMENTS

| | | | |
|---|---|---|---|
| CN | 102454354 | A | 5/2012 |
| CN | 102454469 | A | 5/2012 |
| CN | 102877764 | A | 1/2013 |
| DE | 3145506 | A1 | 5/1983 |
| DE | 19719792 | A1 | 11/1998 |
| DE | 19739827 | A1 | 3/1999 |
| DE | 10019419 | A1 | 10/2001 |
| DE | 112007001053 | T5 | 2/2009 |
| DE | 102009032600 | A1 | 1/2011 |
| DE | 102011116363 | A1 | 4/2012 |
| EP | 2335963 | A1 | 6/2011 |
| FR | 2904950 | A1 | 2/2008 |
| JP | 2001233038 | A | 8/2001 |
| TW | 200944397 | A | 11/2009 |

* cited by examiner

METHOD AND APPARATUS FOR REMOTE TORQUE CONTROL OF AN AERODYNAMIC AIR SHUTTER MECHANISM

FIELD

The present disclosure relates to determining the operability of vehicle aerodynamic air shutters.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Vehicles, including, but not limited to, hybrid engine vehicles, may include a shutter system arranged to control airflow within the vehicle based on environmental conditions. The airflow from the shutter system may be used to enhance the comfort of vehicle passengers or to cool a range of vehicle systems. For example, the shutter system may be controlled to allow increased airflow into the vehicle to compensate for warmer ambient temperatures.

SUMMARY

A system for controlling an aerodynamic shutter of a vehicle includes an ambient temperature estimation module that determines an ambient temperature. A shutter control module that determines whether to actuate the shutter based on the ambient temperature. The shutter control module also determines a predetermined period before selectively applying a predetermined torque value to the shutter. The predetermined period is selected based on the ambient temperature.

In other features, a method for controlling an aerodynamic shutter of a vehicle includes determining an ambient temperature, determining whether to actuate the shutter based on the ambient temperature, determining a predetermined period before selectively applying a predetermined torque value to the shutter. The predetermined period is selected based on the ambient temperature.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Vehicles, including, but not limited to, hybrid engine vehicles, may implement an aerodynamic air shutter system to control airflow within the vehicle based on environmental (i.e., ambient temperature) conditions. The airflow from the shutter system may be used to enhance the comfort of vehicle passengers and/or to cool a range of vehicle systems and/or to improve vehicle fuel economy. For example, the shutter system is controlled to allow an increased airflow into the vehicle to compensate for warmer ambient temperatures. In another example, the shutter system may be controlled based on the speed of the vehicle to optimize vehicle aerodynamics and improve overall vehicle fuel economy.

The shutter system includes individual shutters arranged to open and close based on the environmental conditions. During cold weather, ice may accumulate on the individual shutters, reducing functionality of the shutter system. Similarly, debris from the road may become lodged or embedded on or in the individual shutters, preventing the individual shutters from opening or closing. Accordingly, the functionality of the individual shutters is determined before directing the individual shutters to open and close.

Characteristics of the individual shutters may be indicative of a current status of the individual shutters. For example, an ambient air temperature may be indicative of ice accumulation on the vehicle surface. Similarly, a failed attempt to open the individual shutters may be indicative of an obstruction preventing individual shutter functionality. An aerodynamic air shutter control system according to the present disclosure may determine a current status of the individual shutters and selectively control the individual shutters based on the current status.

Figure 1:
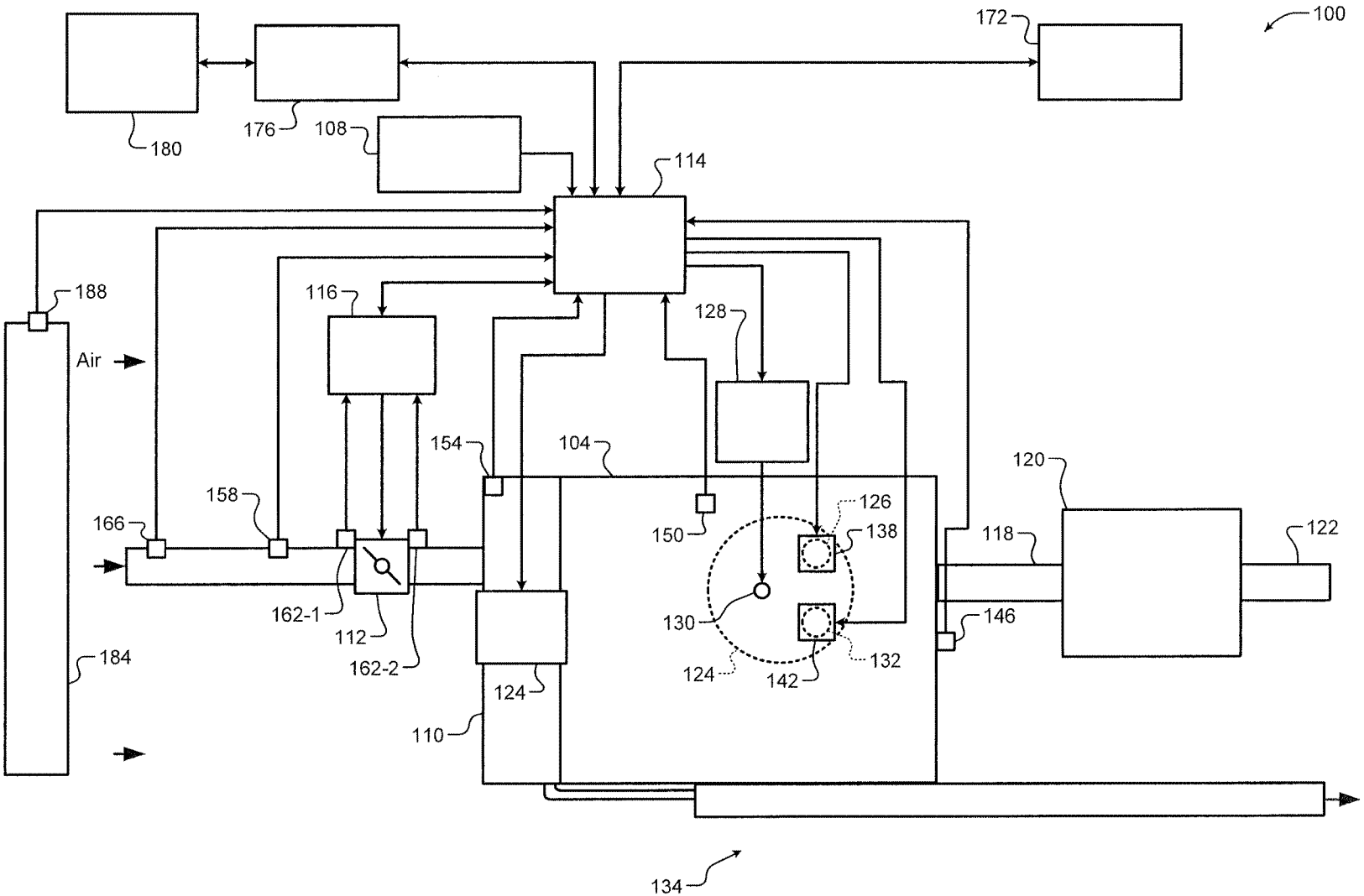
FIG. 1 is a schematic illustration of an engine system according to the present disclosure.

Referring now to FIG. 1, a functional block diagram of an example engine system 100 is presented. The engine system 100 includes an engine 104 that combusts an air/fuel mixture to produce drive torque for a vehicle based on driver input from a driver input module 108.

Air may be drawn into an intake manifold 110 through a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control the amount of air drawn into the intake manifold 110. A torque converter 118 transfers and multiplies torque from the engine 104 and provides the torque to a transmission 120. The transmission 120 operates in one or more gear ratios to transfer the torque to a driveline 122.

Air from the intake manifold 110 is drawn into cylinders of the engine 104. While the engine 104 may include more than one cylinder, for illustration purposes a single representative cylinder 124 is shown. The engine 104 may operate using a four-stroke cycle. The four strokes, described below, may be named the intake stroke, the compression stroke, the combustion stroke, and the exhaust stroke. During each revolution of a crankshaft (not shown), two of the four strokes occur within the cylinder 124. Therefore, two crankshaft revolutions are necessary for the cylinder 124 to experience all four of the strokes.

During the intake stroke, air from the intake manifold 110 is drawn into the cylinder 124 through an intake valve 126. The ECM 114 controls a fuel actuator module 124, which regulates fuel injection to achieve a desired air/fuel ratio. Fuel may be injected into the intake manifold 110 at a central location or at multiple locations, such as near the intake valve 126 of each of the cylinders. In various implementations (not shown), fuel may be injected directly into the cylinders or into mixing chambers associated with the cylinders.

The injected fuel mixes with air and creates an air/fuel mixture in the cylinder 124. During the compression stroke, a piston (not shown) within the cylinder 124 compresses the air/fuel mixture. The engine 104 may be a compression-ignition engine, in which case compression in the cylinder 124 ignites the air/fuel mixture. Alternatively, the engine 104 may be a spark-ignition engine, in which case a spark actuator module 128 energizes a spark plug 130 in the cylinder 124 based on a signal from the ECM 114, which ignites the air/fuel mixture. The timing of the spark may be specified relative to the time when the piston is at its topmost position, referred to as top dead center (TDC).

The spark actuator module 128 may be controlled by a timing signal specifying how far before or after TDC to generate the spark. Because piston position is directly related to crankshaft rotation, operation of the spark actuator module 128 may be synchronized with crankshaft angle.

Generating spark may be referred to as a firing event. The spark actuator module 128 may have the ability to vary the timing of the spark for each firing event. The spark actuator module 128 may even be capable of varying the spark timing for a next firing event when the spark timing is changed between a last firing event and the next firing event.

During the combustion stroke, the combustion of the air/fuel mixture drives the piston away from TDC, thereby driving the crankshaft. The combustion stroke may be defined as the time between the piston reaching TDC and the time at which the piston returns to bottom dead center (BDC).

During the exhaust stroke, the piston begins moving up from BDC and expels the byproducts of combustion through one or more exhaust valves, such as exhaust valve 132. The byproducts of combustion are exhausted from the vehicle via an exhaust system 134.

An intake valve actuator 138 controls actuation of the intake valve 126. An exhaust valve actuator 142 controls actuation of the exhaust valve 132. The intake and exhaust valve actuators 138 and 142 control opening and closing of the intake and exhaust valves 126 and 132, respectively, without one or more camshafts. The intake and exhaust valve actuators 138 and 142 may include, for example, electo-hydraulic actuators, electro-mechanical actuators, or another suitable type of camless valve actuator. Camless intake and exhaust valve actuators enable actuation of each intake valve and exhaust valve of the engine to be controlled independently. The intake and exhaust valve actuators provide what may be referred to as fully flexible valve actuation (FFVA).

Position of the crankshaft may be measured using a crankshaft position sensor 146. Engine speed, engine acceleration, and/or one or more other parameters may be determined based on the crankshaft position. A temperature of the engine coolant may be measured using an engine coolant temperature (ECT) sensor 150. The ECT sensor 150 may be located within the engine 104 or at other locations where the coolant is circulated, such as a radiator (not shown).

A pressure within the intake manifold 110 may be measured using a manifold absolute pressure (MAP) sensor 154. In various implementations, engine vacuum, which is the difference between ambient air pressure and the pressure within the intake manifold 110, may be measured. A mass flowrate of air flowing into the intake manifold 110 may be measured using a mass air flowrate (MAF) sensor 158. In various implementations, the MAF sensor 158 may be located in a housing that also includes the throttle valve 112.

The throttle actuator module 116 may monitor position of the throttle valve 112 using one or more throttle position sensors (TPS) 162. For example, first and second throttle position sensors 162-1 and 162-2 monitor position of the throttle valve 112 and generate first and second throttle positions (TPS1 and TPS2), respectively, based on the throttle position. A temperature of air being drawn into the engine 104 may be measured using an intake air temperature (IAT) sensor 166. The ECM 114 may use signals from the sensors and/or one or more other sensors to make control decisions for the engine system 100.

A transmission control module 172 may control operation of the transmission 120. The ECM 114 may communicate with the transmission control module 172 for various reasons, such as to share parameters and to coordinate engine operation with operation of the transmission 120. For example, the ECM 114 may selectively reduce engine torque during a gear shift. The ECM 114 may communicate with a hybrid control module 176 to coordinate operation of the engine 104 and an electric motor 180.

The electric motor 180 may also function as a generator and may be used to produce electrical energy for use by vehicle electrical systems and/or for storage in a battery. The electric motor 180 may also function as a motor and may be used, for example, to supplement or replace engine torque output. In various implementations, various functions of the ECM 114, the transmission control module 172, and the hybrid control module 176 may be integrated into one or more modules.

Each system that varies an engine parameter may be referred to as an actuator. Each actuator receives an actuator value. For example, the throttle actuator module 116 may be referred to as an actuator and the throttle opening area may be referred to as the actuator value. In the example of FIG. 1, the throttle actuator module 116 achieves the throttle opening area by adjusting an angle of the blade of the throttle valve 112.

Similarly, the spark actuator module 128 may be referred to as an actuator, while the corresponding actuator value may be the amount of spark advance relative to cylinder TDC. Other actuators may include the fuel actuator module 124. For these actuators, the actuator values may correspond to a number of activated cylinders, fueling rate, intake and exhaust valve timing, boost pressure, and EGR valve opening area, respectively. The ECM 114 may control actuator values in order to cause the engine 104 to generate a desired engine output torque.

The air being drawn into an area surrounding engine 104 (e.g., an engine compartment) may be drawn through an aerodynamic air shutter (AAS) 184. The AAS 184 may include a plurality of individual shutters (not shown) spaced apart by a predetermined distance. The individual shutters may be arranged to control the volume of air drawn into the engine compartment. For example, the AAS 184 may be arranged so that the individual shutters are in a first position allowing a first volume of air to be drawn into the engine compartment. Conversely, the AAS 184 may be arranged so that the individual shutters are in a second position allowing a second volume of air to be drawn into the engine compartment. While only first and second positions are described, it is envisioned that the AAS 184 may be arranged for a plurality of shutter positions.

The AAS 184 may also include an AAS module 188. The AAS module 188 communicates various shutter characteristics to the ECM 114 and operates a motor to actuate the individual shutters. For example, the AAS module 188 may communicate a plurality of AAS characteristics including, but not limited to, a first AAS position and a second AAS position. The AAS module 188 may also receive instructions from the ECM 114. The AAS module 188 selectively actuates the individual shutters based on the instructions. For example only, the ECM 114 may instruct the AAS module 188 to open the AAS individual shutters. The AAS module 188 actuates the individual shutters by applying a first predetermined torque value. In some embodiments, the individual shutters may be obstructed. When the ECM 114 determines the individual shutters are obstructed (e.g., applying the first predetermined torque value did not cause the shutters to move), the ECM 114 instructs the AAS module 188 to apply a second predetermined torque value to the individual shutters. For example, the second predetermined torque value may be greater than the first predetermined torque value.

The ECM 114 receives an ambient air temperature from the IAT sensor 166 and a vehicle status from the hybrid control module 176. The ECM 114 selectively controls the AAS 184 based on the ambient air temperature, the vehicle status, and the plurality of AAS characteristics. For example, the ECM 114 may determine that ice has accumulated on the AAS 184. The ECM 114 waits for a predetermined period before instructing the AAS module 188 to open the AAS 184. The predetermined period may correspond to a period of time for allowing ice to melt.

Further, the ECM 114 may determine that the AAS 184 is obstructed. The ECM 114 may instruct the AAS module 188 to apply a predetermined first torque value. The first predetermined torque value may be indicative of a torque value applied to actuate the individual shutters when the individual shutters are unobstructed. The ECM 114 then determines whether the AAS 184 has moved before instructing the AAS module 188 to continue operating the AAS 184.

Figure 2:
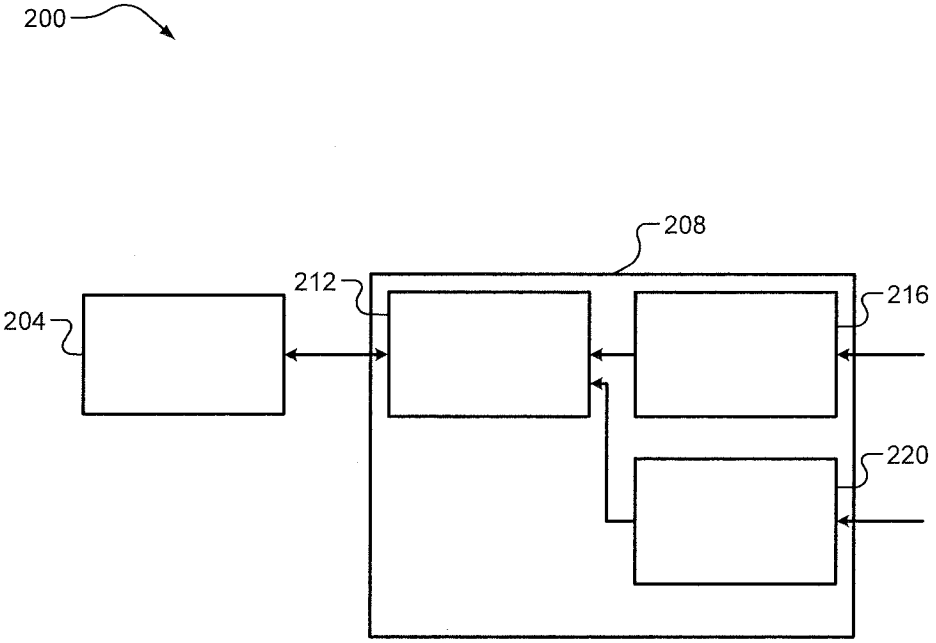
FIG. 2 is a schematic illustration of an aerodynamic air shutter control system according to the present disclosure.

Referring now to FIG. 2, an aerodynamic air shutter control system 200 includes an aerodynamic air shutter (AAS) module 204 and an engine control module (ECM) 208. The ECM 208 includes an AAS control module 212, an ambient temperature determination module 216, and a vehicle status determination module 220. The AAS control module 212 communicates with the AAS module 204. For example, the AAS module 204 may communicate a plurality of AAS positions. The AAS control module 212 may communicate instructions to the AAS module 204. For example, the AAS control module 212 instructs the AAS module 204 to operate an AAS (for example the AAS 184 as shown in FIG. 1).

The AAS control module 212 also receives a plurality of vehicle characteristics, including, but not limited to, an ambient air temperature, a vehicle fan speed, an engine status, a vehicle speed, and an engine runtime period. The ambient temperature determination module 216 determines an ambient air temperature (e.g, a temperature of the air being drawn into the area surrounding the engine 114).

The ambient temperature determination module 216 communicates the ambient air temperature to the AAS control module 212. The AAS control module 212 may determine a current condition of the AAS. For example, the AAS control module 212 determines ice has accumulated on the AAS based on the ambient air temperature. (e.g., if the ambient temperature is less than a threshold).

The vehicle status determination module 220 communicates a plurality of vehicle characteristics including, but not limited to, a vehicle fan speed, a vehicle speed, and an engine runtime to the AAS control module 212. For example, the vehicle status determination module 220 determines that a vehicle fan is operating at a first speed (a first fan speed). The vehicle status determination module 220 also determines a vehicle speed and a period indicative of an engine runtime (an engine runtime period). The vehicle status determination module 220 communicates the first fan speed, the vehicle speed, and the engine runtime period to the AAS control module 212. The AAS control module 212 may determine that a noise masking condition exists based on the first fan speed and the engine runtime. The AAS control module 212 may determine to instruct the AAS module 204 to actuate the AAS when the noise condition exists to mask the audible effect of actuating the AAS.

The AAS control module 212 selectively controls the AAS module 204 based on at least one of the plurality of AAS positions, the ambient air temperature, and the plurality of vehicle characteristics. For example, the AAS control module 212 determines that ice has accumulated on the AAS based on the ambient temperature and instructs the AAS module 204 to maintain a current AAS position. The AAS control module 212 receives an ambient air temperature, a current AAS position, a first fan speed, a vehicle speed, and an engine runtime period.

In some embodiments, the AAS control module 212 verifies the accuracy of the ambient temperature. The AAS control module 212 receives a plurality of ambient temperatures and a vehicle speed. The AAS control module 212 compares first ambient temperature of the plurality of ambient temperatures with a second ambient temperature of the plurality of temperatures after a predetermined period. The AAS control module 212 determines the accuracy of the ambient temperature when the first ambient temperature equals the second ambient temperature. The predetermined period is determined based on the vehicle speed. The AAS control module 212 determines whether the vehicle speed is above a predetermined threshold. When the vehicle speed is above the predetermined threshold, the AAS control module 212 decreases the predetermined period. Conversely, when the vehicle speed is below a predetermined threshold, the AAS control module 212 increases the predetermined period.

The AAS control module 212 compares the ambient air temperature to a set of predetermined temperature ranges. The predetermined temperature ranges include, for example only, temperatures below 10° C., temperatures between 10° C. and 20° C., and temperatures above 20° C. When the AAS control module 212 determines the ambient air temperature is below 10° C., the AAS control module 212 determines that ice has accumulated on the AAS and instructs the AAS module 204 to maintain the current AAS position. Conversely, when the AAS control module 212 determines the ambient temperature is above 20° C., the AAS control module 212 instructs the AAS module 212 to apply a predetermined normal torque value to the AAS.

When the AAS control module 212 determines the ambient temperature is between 10° C. and 20° C., the AAS control module 212 determines how long to wait before instructing the AAS module 204 to actuate the AAS based on the first fan speed and the ambient temperature. For example, the AAS control module 212 determines to wait a first waiting period when the first fan speed indicates a high fan speed. Similarly, the AAS control module 212 may determine to wait a second waiting period when the first fan speed indicates a low fan speed. As the ambient temperature changes, the AAS control module 212 adjusts the first and second waiting periods. For example, as the ambient temperature increases, the AAS control module 212 decreases the length of the first and second waiting periods. While only high and low fan speeds are described, it is envisioned that any variable fan speed may be implemented.

The AAS control module 212 compares the first fan speed to a predetermined fan speed threshold. Fan speeds above the predetermined fan speed threshold correspond to a first predetermined period. Conversely, fan speeds not above the predetermined fan speed threshold correspond to a second predetermined period. When the AAS control module 212 determines the first fan speed is above the predetermined fan speed threshold, the AAS control module 212 instructs the AAS module 204 to wait for the first predetermined period before applying the predetermined normal torque value to the AAS. Conversely, when the AAS control module 212 determines the first fan speed is not above a predetermined fan speed threshold, the AAS control module 212 instructs the AAS module 204 to wait for the second predetermined period before applying the predetermined normal torque value to the AAS. The AAS control module 212 monitors the ambient temperature. As the ambient temperature changes, the AAS control module 212 adjusts the first and second predetermined periods to account for the change in ambient temperature.

In another example, when the AAS control module 212 determines the ambient temperature is between 10° C. and 20° C., the AAS control module 212 compares the engine runtime period to a predetermined engine runtime threshold. Engine runtime periods above the predetermined engine runtime threshold correspond to a first predetermined period. Conversely, engine runtime periods not above the predetermined engine runtime threshold correspond to a second predetermined period. When the AAS control module 212 determines the engine runtime period is above the predetermined engine runtime threshold, the AAS control module 212 instructs the AAS module 204 to wait for the first predetermined period before applying the predetermined normal torque value to the AAS. Conversely, when the AAS control module 212 determines the engine runtime period is not above the predetermined engine runtime threshold, the AAS control module 212 instructs the AAS module 204 wait for the second predetermined period before applying the predetermined normal torque value to the AAS. The AAS control module 212 monitors the ambient temperature. As the ambient temperature changes, the AAS control module 212 adjusts the first and second predetermined periods to account for the change in ambient temperature.

In another example, the AAS control module 212 may determine the AAS is obstructed and selectively control the AAS module 204 to remove the obstruction. The AAS control module 212 receives a first AAS position of the plurality of AAS positions. The AAS control module 212 instructs the AAS module 204 to apply a first predetermined torque to the AAS. The AAS control module 212 then receives an ambient air temperature, a second AAS position of the plurality of AAS positions, a first fan speed, and an engine status.

The AAS control module 212 compares the first AAS position with the second AAS position to determine whether the individual shutters have moved. For example, the AAS individual shutters may be obstructed by mud or debris accumulated while the vehicle was being used off-road. When the AAS individual shutters are obstructed, the individual shutters will not function as designed. Accordingly, an adjusted torque value may be applied to remove the obstruction from the individual shutters.

When the AAS control module 212 determines a difference between the first and second AAS positions (i.e., that the shutters have moved), the AAS control module 212 instructs the AAS module 204 to continue to operate the AAS by applying the first predetermined torque value. When the AAS control module 212 determines the first AAS position is equivalent to the second AAS position (i.e., that the shutters have not moved), the AAS control module 212 determines whether to instruct the AAS module 204 to apply a second predetermined torque value based on the first fan speed and the engine status. For example, the AAS control module 212 determines whether noise masking conditions (e.g., noise from a fan running) exists before determining to apply the second predetermined torque value to the AAS. The noise masking conditions allow the noise from the individual shutter movement to be masked from a vehicle driver or a vehicle passenger.

When the AAS control module 212 determines the first fan speed is above a predetermined fan speed threshold, the AAS control module 212 instructs the AAS module 204 to apply the second torque value to the AAS. The second predetermined torque value may be a greater torque value than the first predetermined torque value. Conversely, when the AAS control module 212 determines the first fan speed is not above a predetermined fan speed threshold, the AAS control module 212 instructs the AAS module 204 to maintain the current position of the AAS.

In another example, the AAS control module 212 may also determine whether the vehicle engine is running based on the engine status. For example, the engine status may be indicative of the engine running. When the AAS control module 212 determines the engine is running, the AAS control module 212 may instruct the AAS module 204 to apply the second predetermined torque value to the AAS. The AAS control module 212 then receives a third AAS position. The AAS control module 212 determines whether the third AAS position differs from the second AAS position. When the third AAS position differs from the second AAS position, the AAS control module 212 selectively controls the AAS module 204 to actuate the AAS. The AAS module 204 may then apply a predetermined normal torque value to the AAS.

Figure 3:
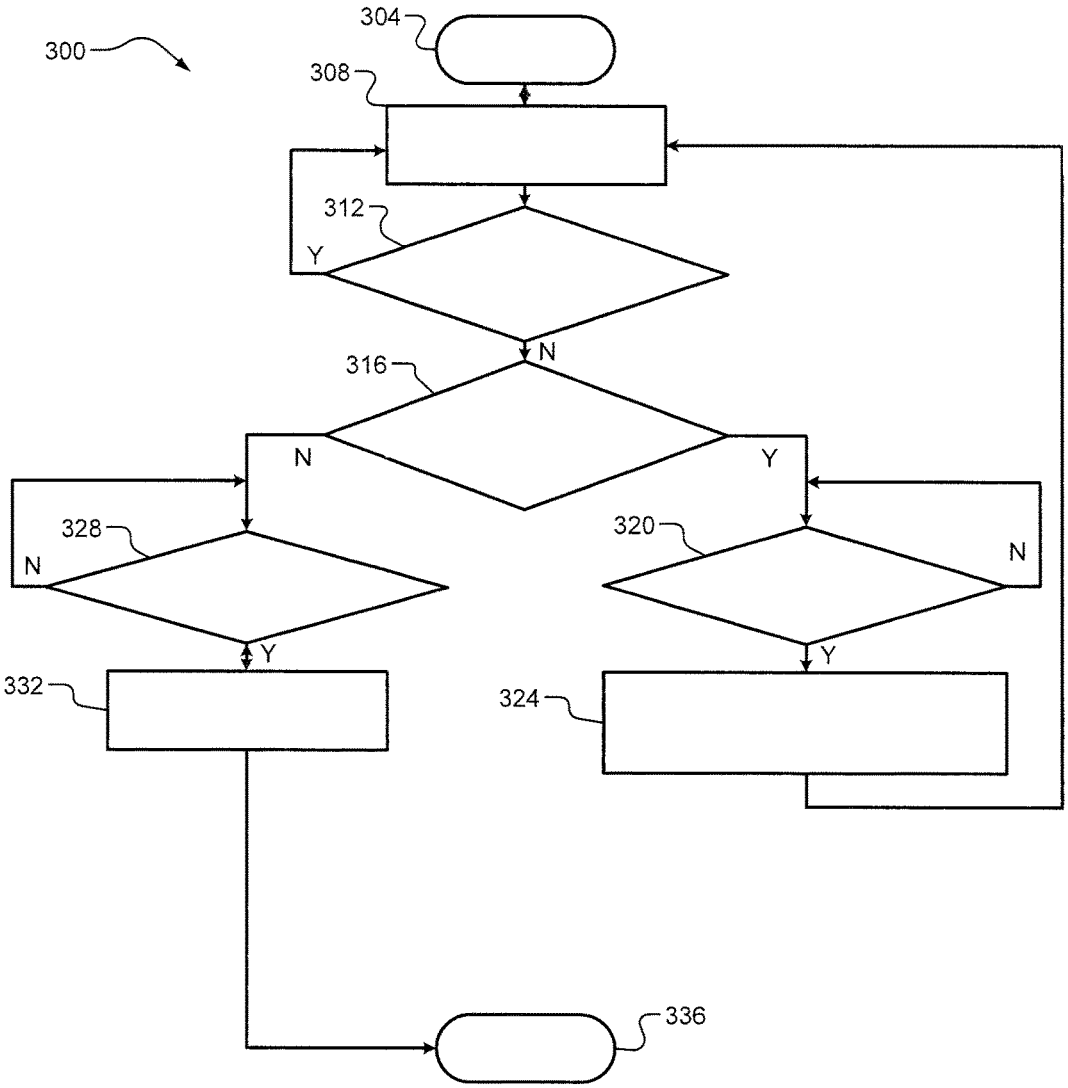
FIG. 3 is a flow diagram illustrating an aerodynamic air shutter control method according to the present disclosure.

Referring now to FIG. 3 an aerodynamic air shutter control method 300 begins at 304. At 308, the method 300 receives an ambient temperature. At 312, the method 300 determines whether the ambient temperature is below 10° C. If true, the method 300 continues at 308. If false, the method 300 continues at 316. At 316, the method 300 determines whether the ambient temperature is between 10° C. and 20° C. If true, the method 300 continues at 320. If false, the method 300 continues at 328. At 320, the method 300 determines whether noise masking conditions are present. If false, the method 300 continues at 320. If true, the method 300 continues at 324. At 324, the method 300 gradually increases the torque value applied to the aerodynamic air shutters. The method 300 continues at 308. At 328, the method 300 determines whether noise masking conditions are present. If false, the method 300 continues at 328. If true, the method 300 continues at 332. At 332, the method 300 applies a predetermined torque value to the AAS. The method 300 ends at 336.

Figure 4:
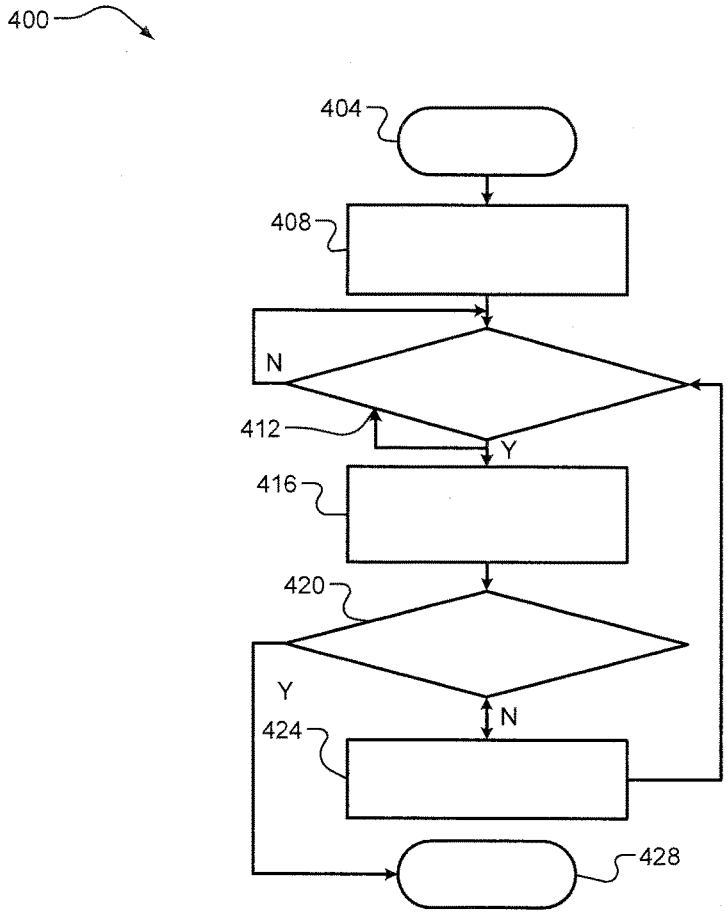
FIG. 4 is a flow diagram illustrating an alternative aerodynamic air shutter control method according to the present disclosure.

Referring now to FIG. 4 an alternative aerodynamic air shutter control method 400 begins at 404. At 408, the method 400 sets a torque adjustment value equal to a first predetermined torque value. At 412, the method 400 determines whether noise masking conditions are present. If false, the method 400 continues at 412. If true, the method 400 continues at 416. At 416, the method 400 applies a predetermined torque value plus the torque adjustment value to the AAS. At 420, the method 400 determines whether the AAS moved (e.g, the method 400 determines whether the AAS is obstructed). If true, the method 400 ends at 428. If false, the method 400 continues at 424. At 424, the method 400 increments the torque adjustment value by a torque adjustment offset. For example, the torque adjustment offset may be added to the first predetermined torque value in order to apply an increased torque value to the AAS. Applying the increased torque value may remove an obstruction from the AAS. The method 400 continues at 412.

Figure 5:
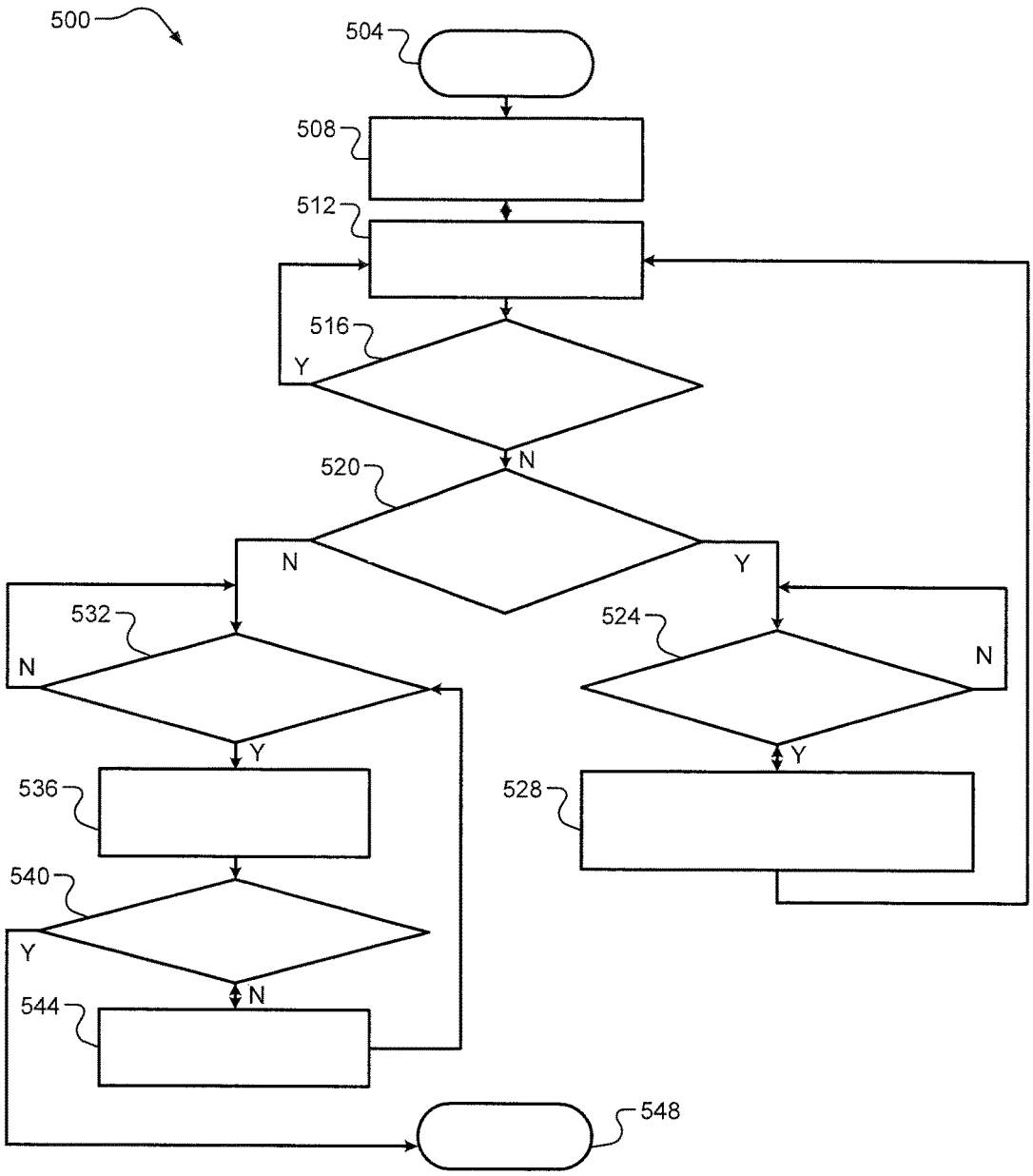
FIG. 5 is a flow diagram illustrating another alternative aerodynamic air shutter control method according to the present disclosure.

Referring now to FIG. 5 an alternative aerodynamic air shutter control method 500 begins at 504. At 508, the method 500 sets a torque adjustment value equal to a first predetermined torque value. At 512, the method 500 receives an ambient temperature. At 516, the method 500 determines whether the ambient temperature is below 10° C. If true, the method 500 continues at 512. If false, the method 500 continues at 520. At 520, the method 500 determines whether the ambient temperature is between 10° C. and 20° C. If true, the method 500 continues at 524. If false, the method 500 continues at 532. At 524, the method 500 determines whether noise masking conditions are present. If false, the method 500 continues at 524. If true, the method 500 continues at 528. At 528, the method 500 gradually increases the torque value applied to the AAS. The method 500 continues at 512. At 532, the method 500 determines whether noise masking conditions are present. If false, the method 500 continues at 532. If true, the method 500 continues at 536. At 536, the method 500 applies a predetermined torque value plus the torque adjustment value to the AAS. At 540, the method 500 determines whether the AAS moved (e.g, the method 400 determines whether the AAS is obstructed). If true, the method 500 ends at 548. If false, the method 500 continues at 544. At 544, the method 500 increments the torque adjustment value by a torque adjustment offset. For example, the torque adjustment offset may be added to the first predetermined torque value in order to apply an increased torque value to the AAS. Applying the increased torque value may remove an obstruction from the AAS. The method 500 continues at 532.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A system for controlling an aerodynamic shutter of a vehicle comprising:

an ambient temperature estimation module that determines an ambient temperature; and a shutter control module that determines whether to actuate the shutter based on the ambient temperature and a predetermined period, wherein the shutter control module does not actuate the shutter when the ambient temperature is less than a first threshold, the shutter control module selectively applies an adjustable torque value to the shutter subsequent to the predetermined period when the ambient temperature is greater than the first threshold and less than a second threshold, wherein applying the adjustable torque value includes gradually increasing the adjustable torque value applied to the shutter in response to the ambient temperature being greater than the first threshold and less than the second threshold, and the shutter control module selectively applies a predetermined torque value to the shutter when the ambient temperature is greater than the second threshold, wherein the predetermined period is adjusted as the ambient temperature increases between the first threshold and the second threshold.

2. The system of claim 1 wherein further comprising a vehicle status determination module that determines at least one vehicle characteristic and wherein the predetermined period is selected based on the ambient temperature and the at least one vehicle characteristic.

3. The system of claim 2 wherein the at least one vehicle characteristic indicates at least one of a fan is on and a vehicle speed.

4. The system of claim 1 wherein the shutter control module selectively applies a first torque value to the shutter and receives a shutter status.

5. The system of claim 4 wherein the shutter control module determines whether the shutter has moved based on the shutter status.

6. The system of claim 5 wherein the shutter control module applies a second torque value based on the determination of whether the shutter has moved.

7. The system of claim 6 wherein the second torque value is greater than the first torque value.

8. A method controlling an aerodynamic shutter of a vehicle, the method comprising:

determining an ambient temperature;

determining whether to actuate the shutter based on the ambient temperature and a predetermined period, wherein determining whether to actuate the shutter includes not actuating the shutter when the ambient temperature is less than a first threshold, selectively applying an adjustable torque value to the shutter subsequent to the predetermined period when the ambient temperature is greater than the first threshold and less than a second threshold, wherein applying the adjustable torque value includes gradually increasing the adjustable torque value applied to the shutter in response to the ambient temperature being greater than the first threshold and less than the second threshold, and selectively applying a predetermined torque value to the shutter when the ambient temperature is greater than the second threshold, wherein the predetermined period is adjusted as the ambient temperature increases between the first threshold and the second threshold.

9. The method of claim 8 further comprising determining at least one vehicle characteristic and wherein the predetermined period is selected based on the ambient temperature and the at least one vehicle characteristic.

10. The method of claim 9 wherein the at least one vehicle characteristic indicates at least one of a fan is on and a vehicle speed.

11. The method of claim 8 further comprising selectively applying a first torque value to the shutter and receiving a shutter status.

12. The method of claim 11 further comprising determining whether the shutter has moved based on the shutter status.

13. The method of claim 12 further comprising applying a second torque value based on the determination of whether the shutter has moved.

14. The method of claim 13 wherein the second torque value is greater than the first torque value.

* * * * *